US005380985A

United States Patent [19]

Graham

[11] Patent Number: 5,380,985

[45] Date of Patent: Jan. 10, 1995

[54] PRESENCE DELECTOR FOR CONTROLLING AN ELECTRIC RANGE

[76] Inventor: Larry J. Graham, P.O. Box 1127, Dillon, S.C. 29536

[21] Appl. No.: 178,412

[22] Filed: Jan. 6, 1994

[51] Int. Cl.[6] ..... H05B 3/68; H05B 1/02

[52] U.S. Cl. ..... 219/452; 219/506

[58] Field of Search ..... 219/452, 451, 453, 412, 219/413, 506

[56] References Cited

U.S. PATENT DOCUMENTS 4,775,913 10/1988 Ekblad ..... 361/179

5,160,831 11/1992 Thaler ..... 219/506

*Primary Examiner*—Teresa J. Walberg

[57] ABSTRACT

An apparatus for controlling an electric range having a plurality of range top heating elements includes a detector which reacts to a person being within a predetermined distance in front of the electric range. The detector is mounted inside the range and has input and output voltages of 110–120 volts AC. An electromagnetic switch mounted inside the range is activated by the detector to automatically disconnect power to the range when the range has been unattended for a predetermined period of time. The detector is electrically connected to a range top heating element to obtain its input voltage.

2 Claims, 2 Drawing Sheets

PRESENCE DELECTOR FOR CONTROLLING AN ELECTRIC RANGE

FIELD OF THE INVENTION

This invention concerns the high voltage (230 volts AC) range and the control of its power supply. It is dependant upon an operator being in attendance. As long as the operator is within a preset distance in front of the range, it operates normally. But if the range is left unattended for a predetermined time period the high voltage will be turned off to the range top or cooking surfaces only. It will remain off until an operator returns. This improvement to the range can be installed by a qualified technician or manufactured internally. This does not alter the appearance of the range and is safe, maintenance free, and tamper resistant.

BACKGROUND OF THE INVENTION

For many years the cooking surfaces (range top) have been considered an acceptable hazard. Occasionally an individual will turn on a range and forget it. The unattended range (while turned on) is one of the leading causes of property damage and death by fire in this and many other countries.

The invention set forth herein, therefore, provides for an apparatus that effectively controls a high voltage range top without effecting the oven. It has simple circuitry which is automatic, economic, and, being internal, is tamper resistant.

This device will greatly reduce the danger of this type of fire and will also eliminate possible range malfunctions.

SUMMARY AND OBJECTS OF THE INVENTION

In view of the foregoing, it is apparent there is a need to control the cooking surfaces or range top of a high voltage range. It is, therefore, a primary object of the present invention to provide a means of controlling the power supply of the range top through an internal apparatus without drastically altering the circuitry or the appearance of the range.

It is another object of the present invention to provide for an automatic control of the high voltage without operator intervention and without the allowing operator to disconnect or tamper with this device.

It is yet another object of this invention to provide for the control system of this device to remain in a nonfunctional state until it is ready to be used by means of being activated by the range top switches.

It is a further object of this invention to provide for the maintaining of the high voltage in a disabled state when the range is not in use. This is done by means of a magnetic line contactor switch which remains in an open (off) position until activated.

It is yet a further object of this invention to provide for the use of the existing range top indicator to show its status.

It is an additional object of this invention to provide for it to draw its own power from the power supply of the high voltage range it controls. This is done through simple circuitry and an economical design.

Those and other objects are accomplished by the instant invention by means of a detector, which powers a magnetic line contactor (electromagnetic switch) , and is connected to the surface switches of the range in parallel circuit with the range top indicator. Upon turning on any or all of the surface switches, power is simultaneously supplied to the detector and the surface indicator lamp, which will illuminate. The detector tests for an operator and if this condition is met, it will activate the magnetic line contactor, which turns on the high voltage to the range top. If the operator leaves the detection area for a predetermined time the magnetic line contactor is deactivated, turning off the high voltage to the range top. The surface indicator and the detector will remain on. When an operator returns, the magnetic line contactor is reactivated turning the high voltage back on. This process will continue until all surface switches are manually turned off.

With these and other objects, advantages and features of the invention that may become hereinafter apparent, the nature of the invention may be more clearly understood by reference to the following detailed description of the invention, the appended claims and to the several drawings attached herein.

DETAILED DESCRIPTION OF THE PREFERRED EMBODIMENT

Figure 1:
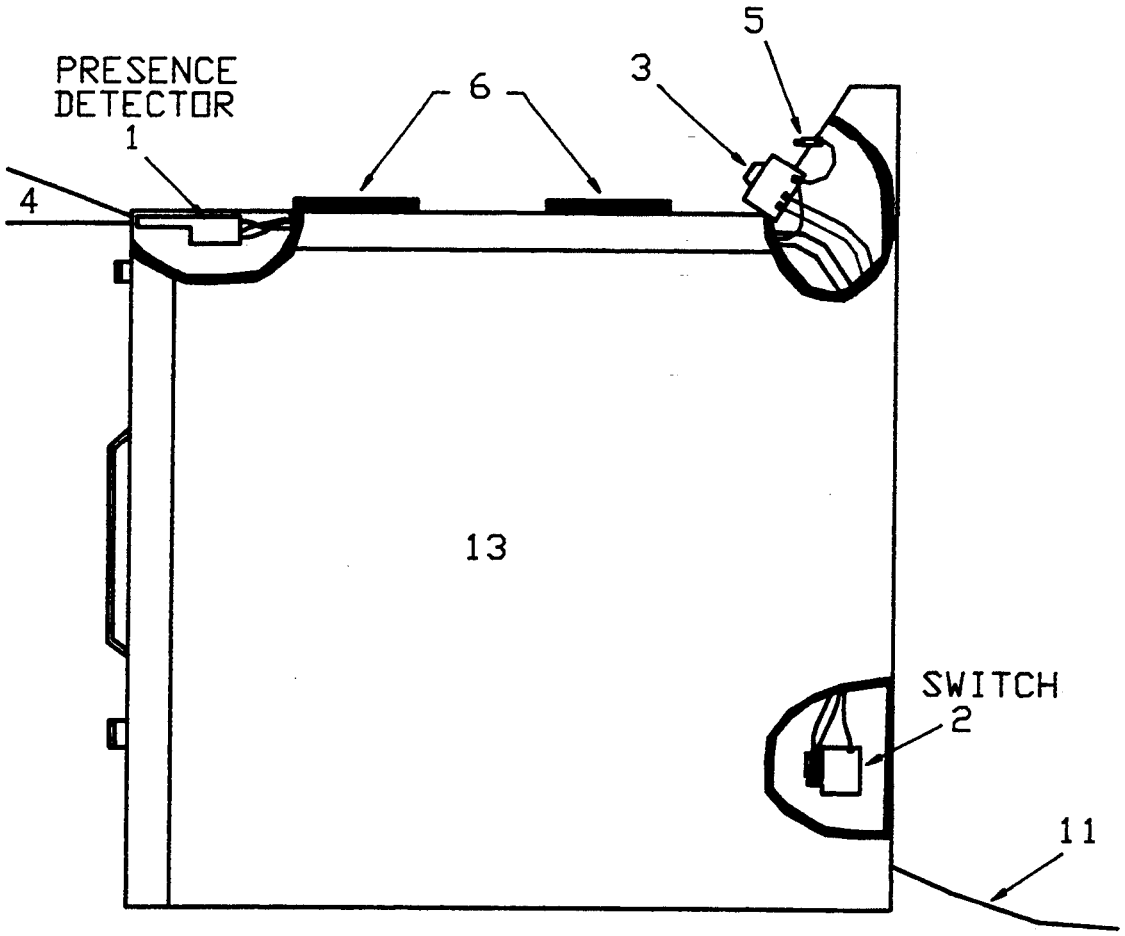
FIG. 1 is a side view of a free-standing high voltage range with three cut-aways showing the locations of the present invention.

Referring now to the drawings wherein like parts are designated by like reference numerals throughout, there is illustrated in FIG. 1 a side view of a free-standing high voltage (230 volts AC) range 13 showing the employment of the present invention. This invention can also be employed in drop-in or counter-top ranges (not shown).

FIG. 1 has three cut-aways, at top rear, displays one of the four surface switches 3 and the surface lamp indicator 5. The surface switches not only power the range top 6 and indicator lamp 5 but also the present invention which is a detector 1 (any detector which will react to the presence of a person can be used) located in the front of the range 13, peering through a small opening, with its detection field 4 three feet above the floor and extending upwards. This detector 1 in turn powers a magnetic line contactor (electromagnetic switch) 2 located in the rear of the range 13 near the incoming power supply 11.

Figure 2:
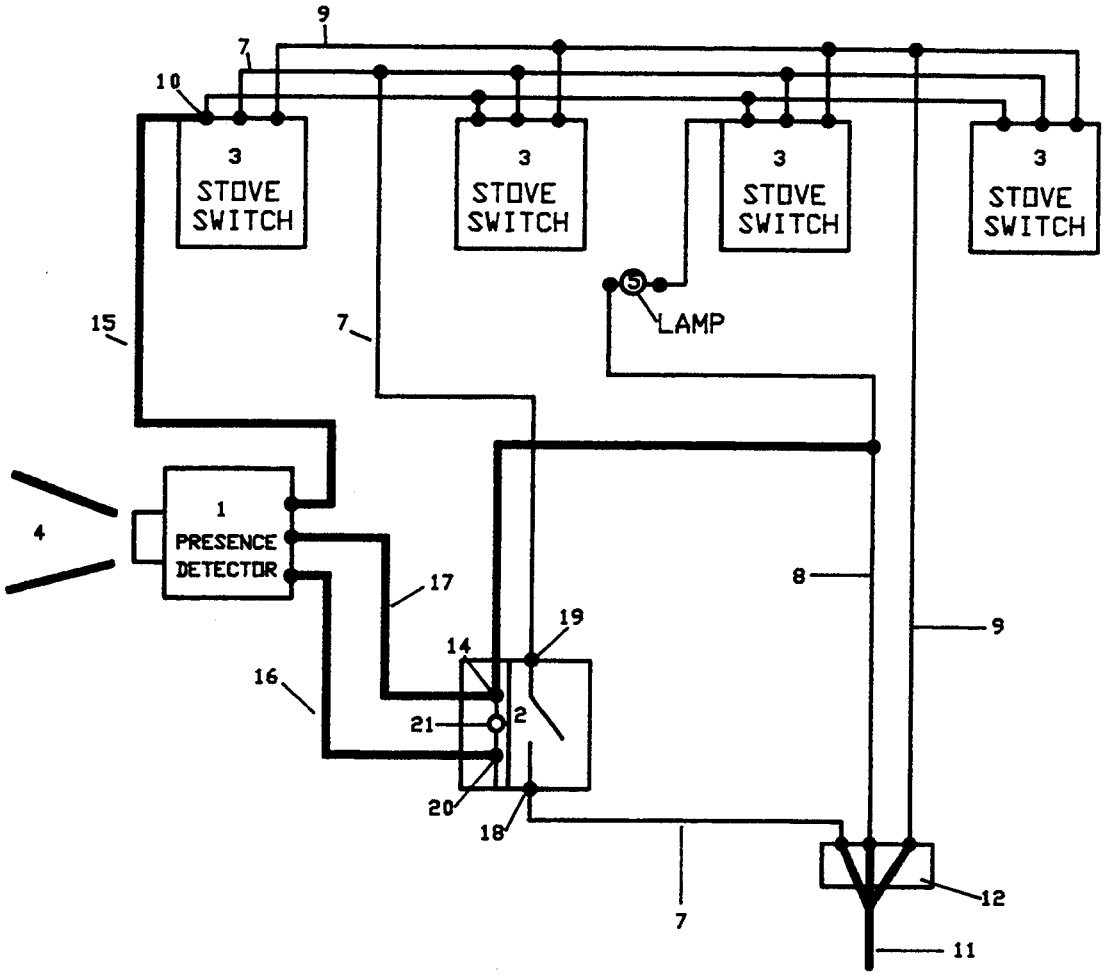
FIG. 2 is a typical electrical diagram of a range with the present invention incorporated into it.

FIG. 2, being a typical wiring diagram for a high voltage range top, will explain the circuitry of the present invention.

It should be noted, the detector 1; magnetic line contactor 2; the detection field 4; wires 15, 16, 17 (drawn in heavier lines); and connection points 14, 18, 19, 20 are the present invention all else is provided with the range.

The incoming power supply 11 (230 volts AC) is connected to the power block 12 for distribution throughout the range 13 . Line one (L1) 7 extends from power block 12 to the incoming terminal 18 of the magnetic line contactor 2 then extends from the outgoing terminal 19 to a parallel connection labeled "L1" on all four surface switches 3. Line two (L2) 9 extends from the power block 12 to a parallel connection labeled "L2" on all surface switches 3 and is not disturbed due to being the on-line power source of the present invention and the surface indicator lamp 5.

The detector 1 power wire 15 is connected to the light terminal labeled "p" 10 on any surface switch 3. This is the parallel light circuit. The common wire 17 of the detector 1 is connected to the magnetic line contactor 2 at a terminal 14 and is then extended on to the ground wire 8 of the range 13. The control wire 16 of the detector 1 is connected to a terminal 20 of the magnetic line contactor 2. This connection allows for the detector 1 to control the 110–120 volts AC electromagnet 21 portion of the magnetic line contactor.

One skilled in the art would be aware this circuitry would control only one side ("L1" 7) of the high voltage circuit which is all that need be turned off and on to be effective.

With this circuitry in place, should any one of the surface switches 3 be manually turned on, the surface light 5 will illuminate and the detector 1 will activate simultaneously. The detector 1 upon seeing an operator will activate the magnetic line contactor 2 which will close and complete the high voltage circuit. As long as the operator is detected the range 13 operates normally. Should the operator leave the detection area 4 for a period of approximately three minutes the detector will deactivate the high voltage. When an operator returns the nigh voltage will be turned back on. The detector 1 and the surface lamp 5 will remain on and this process will continue until all surface switches 3 are manually turned off.

I claim:

1. An apparatus for controlling an electric range having a plurality of range top heating elements, the apparatus comprising:

a detector which reacts to a person being within a predetermined distance in front of an electric range said detector being mounted inside the range and having an input and output voltage of 110–120 volts AC, an electromagnetic switch mounted inside the range and being activated by said detector to automatically disconnect power to the range when the range has been unattended for a predetermined period of time, said detector being electrically connected to a range top heating element to obtain said input voltage.

2. The apparatus of claim 1 wherein:

said switch only disconnects power to the range top heating elements and not to any other electrical devices in said range.

* * * * *